US008888149B2

(12) United States Patent
Lehr

(10) Patent No.: US 8,888,149 B2
(45) Date of Patent: Nov. 18, 2014

(54) SANITARY DOOR LATCH SYSTEM

(76) Inventor: Robert Joshua Lehr, Wilsonville, OR (US)

( * ) Notice: Subject to any disclaimer, the term of this patent is extended or adjusted under 35 U.S.C. 154(b) by 604 days.

(21) Appl. No.: 13/079,712

(22) Filed: Apr. 4, 2011

(65) Prior Publication Data

US 2012/0119521 A1 May 17, 2012

Related U.S. Application Data

(60) Provisional application No. 61/413,920, filed on Nov. 15, 2010.

(51) Int. Cl.
*E05C 3/06* (2006.01)

(52) U.S. Cl.
USPC ..... 292/201; 292/DIG. 15

(58) Field of Classification Search
USPC ..... 292/201, DIG. 15, DIG. 12
See application file for complete search history.

(56) References Cited

U.S. PATENT DOCUMENTS 533,571 A * 2/1895 Tower ..... 49/263
584,588 A * 6/1897 Headland ..... 292/255
1,603,722 A * 10/1926 Stanley ..... 292/255
2,749,169 A * 6/1956 Johnson ..... 292/332
2,795,668 A * 6/1957 Puckett ..... 200/81 H
4,421,350 A * 12/1983 Gotomyo ..... 292/123
4,621,848 A * 11/1986 Pierce ..... 292/336.3
5,193,863 A * 3/1993 McBain ..... 292/255
5,217,265 A * 6/1993 Lerner et al. ..... 292/200
6,176,042 B1 * 1/2001 Rossman et al. ..... 49/463
6,967,580 B1 * 11/2005 Schulze ..... 340/573.7
7,270,352 B1 * 9/2007 Stuart ..... 292/255
7,619,171 B2 * 11/2009 Horvath et al. ..... 200/86.5

* cited by examiner

*Primary Examiner* — Mark Williams

(74) *Attorney, Agent, or Firm* — Marger Johnson & McCollom PC

(57) ABSTRACT

A door latch system may include a foot actuator, a first disk, a first linkage coupled to the foot actuator and the first disk, a locking mechanism, and a second linkage coupled to the first disk and the locking mechanism. The first linkage may be configured to rotate the first disk from a first position to a second position responsive to a user actuating the foot actuator. The second linkage may be configured to cause the locking mechanism to transition from a first state to a second state responsive to the first disk rotating from the first position to the second position.

20 Claims, 8 Drawing Sheets

SANITARY DOOR LATCH SYSTEM

CROSS-REFERENCE TO RELATED APPLICATION

The present application claims the benefit of U.S. Provisional Patent Application Ser. No. 61/413,920, titled "SANITARY DOOR LATCH SYSTEM" and filed on Nov. 15, 2010, the contents of which are fully incorporated by reference herein.

BACKGROUND

This disclosure relates to a door latch systems and, in particular to feet-activated sanitary door latch systems.

Portable human waste facilities, commonly known as a "Porta-Poti", can include a locking mechanism actuated by hand. In particular, a hand lock can slide across from the door to the structure's sidewall to create a locked system. However, this system can create an unsanitary condition. In particular, hand washing stations for users of the waste facility are typically located outside of the waste facility. As a result, the user must touch the locking mechanism by hand before exiting the waste facility.

This can result in an unsanitary accumulation of human waste on the locking mechanism and transfer to users of the waste facility. Even if hand washing stations are present within the waste facility, some users may not use such washing stations. Moreover, even if the locking mechanism is in fact clean, a perception can remain that the locking mechanism is not clean. Regardless, users resort to various contortions, such as using elbows, forearms, or the like to actuate the locking mechanism without using their hands.

DETAILED DESCRIPTION

Embodiments will be described where a door latch system need not be actuated by hand. In an embodiment, the latch system can be actuated with a user's foot.

Figure 1:
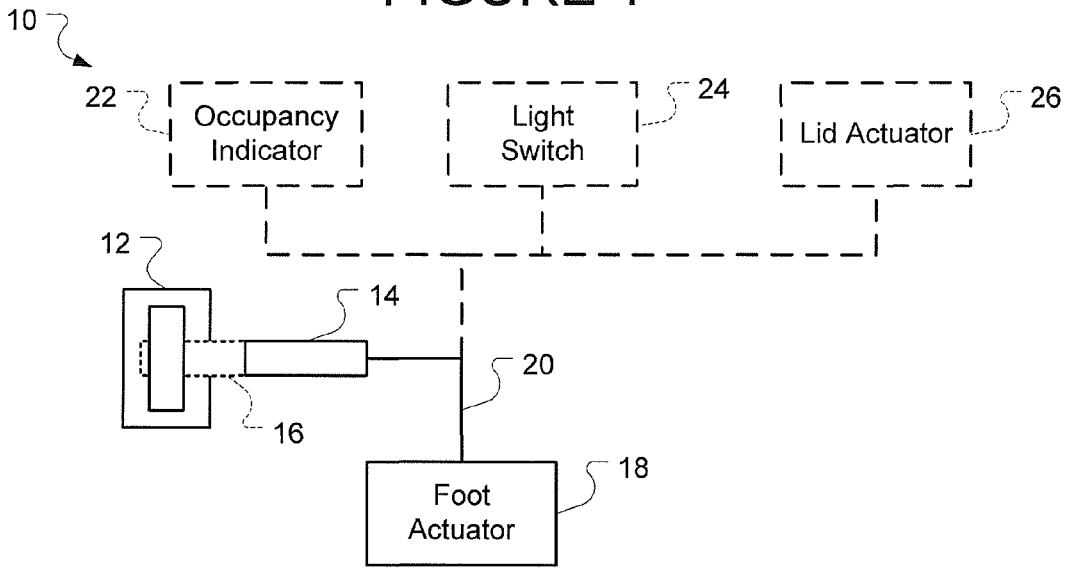
FIG. 1 is a block diagram of a door latch system according to an embodiment.

FIG. 1 is a block diagram of a door latch system according to an embodiment. The door latch system 10 includes a latch plate 12, a bolt 14, a foot actuator 18, and a linkage 20. The bolt 14 is configured to engage with the latch plate 12 as illustrated in position 16. The bolt 14 is coupled to the foot actuator 18 through the linkage 20.

The latch plate 12 can include any variety of latch plates. As illustrated, the latch plate 12 includes a slot through which the bolt 14 can pass as illustrated by position 16. However, the latch plate 12 can take other forms. For example, the latch plate 12 can include a hook, a hole, a strike plate, or any other structure configured to receive the particular bolt 14.

The bolt 14 can similarly be any of a variety of bolts corresponding to the latch plate 12. For example, the bolt 14 can be a sliding bolt as illustrated. In another embodiment, the bolt 14 can be a rotating bolt. The bolt 14 can be a spring loaded bolt, a dead bolt, or the like. Moreover, although one bolt 14 has been illustrated, the latch system 10 can include multiple bolts 14 and multiple corresponding latch plates 12.

The linkage 20 can be any variety of linkage. As will be described in further detail below, the linkage 20 can be a mechanical linkage transferring motion of the foot actuator 18 into motion of the bolt 14.

As the bolt 14 can be actuated in response to the foot actuator 18, a user need not use his hands to open a door. For example, the latch system 10 can be mounted on a door of a portable waste facility. In an embodiment, the latch system 10 can be mounted to an existing door of the waste facility, form part of a replacement door, or be incorporated into the facilities original design. The user can actuate the foot actuator 18 with his foot and then use his foot to open the door. As a result, skin contact with unsanitary surfaces within the waste facility can be substantially avoided.

In addition, to the bolt 14, other devices, structures, systems, and the like can be actuated in response to the foot actuator 18. Such optional systems include an occupancy indicator 22, a light switch 24, and a lid actuator 26. For example, when the foot actuator 18 is actuated to move the bolt 14 into the lock position, the linkage 20 can be coupled to the occupancy indicator to change the indicator from unoccupied to occupied. Similarly, when the bolt 14 is move into the locked position, a light internal to the waste facility can be turned on with the light switch 24.

Furthermore, the linkage 20 can also be coupled to the lid actuator 26. The lid actuator 26 can be configured to open and close a lid of a toilet in the waste facility. In particular, venting of the waste facility can be improved if the lid of the toilet is in the closed position when the waste facility is not in use. However, the lid is another surface similar to a locking mechanism that can be contaminated. Accordingly, when the user actuates the foot actuator 18 to lock the waste facility, the lid can be opened. Similarly, when the user actuates the foot actuator 18 to unlock the waste facility, the lid can be closed. Thus, not only can an operation likely necessary to allow a user to exit be actuated by the foot actuator 18, but a preferable operation, albeit undesirable from a user's perspective, can also be performed in response to the same actuation.

Figure 2:
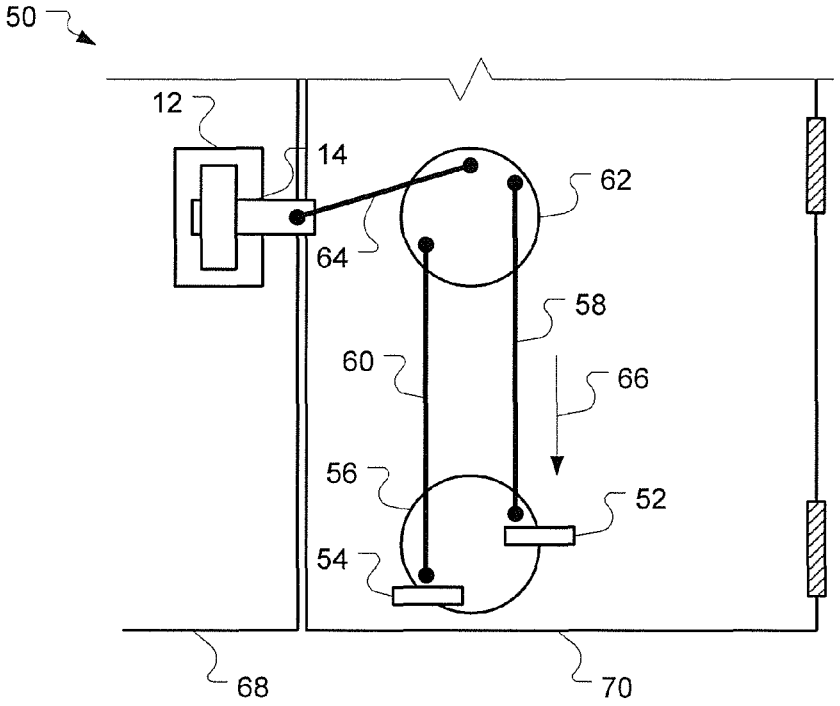
FIG. 2 is a diagram of a door latch system using pedals according to an embodiment.

FIG. 2 is a diagram of a door latch system using pedals according to an embodiment. In this embodiment, the latch system 50 includes a disk 56. Pedals 52 and 54 are mounted on the disk 56. A user can step on the pedals 52 and 56 to rotate the disk 56 is opposite directions.

Linkages 58 and 60 couple disk 62 to disk 56. In this embodiment, the linkages 58 and 60 couple the disks 56 and 62 such that the disks 56 and 62 both rotate in response to actuation of the pedals 52 or 54. Linkage 64 coupled the disk 62 to the bolt 14, illustrated in the closed position.

The disks 62 and 56 are mounted to the door 70 in this embodiment. The latch plate 12 is mounted on the sidewall 68. Accordingly, a user can press on the pedals 52 and 54 with his foot to open and close the latch, respectively. For example, a user can press down on pedal 52 in direction 66. The bolt 14 can slide out of the latch plate 12, allowing the door 70 to swing open. In particular, as the user's foot is already on the pedal 52 that is coupled to the door 70, the user can push using his foot to open the door. Thus, not only can the user substantially avoid skin contact with surfaces of the waste facility, the user can open the door and still substantially avoid further skin contact.

In this embodiment, a user can also press on pedal 54 to latch the door 70. For example, the door 70 can be a spring loaded door with a force applied to return to a closed state. After a user enters the waste facility, the door will automatically close. The user can then press on the pedal 54 to latch the door 70. Thus, the user need not have skin contact with a surface of the waste facility whether entering or exiting.

Although illustrated as exposed, the various linkages, disks, and the like can be concealed behind panels of the door 70. Thus, the various moving parts can be protected, and a user can be protected from the moving parts.

Figure 3:
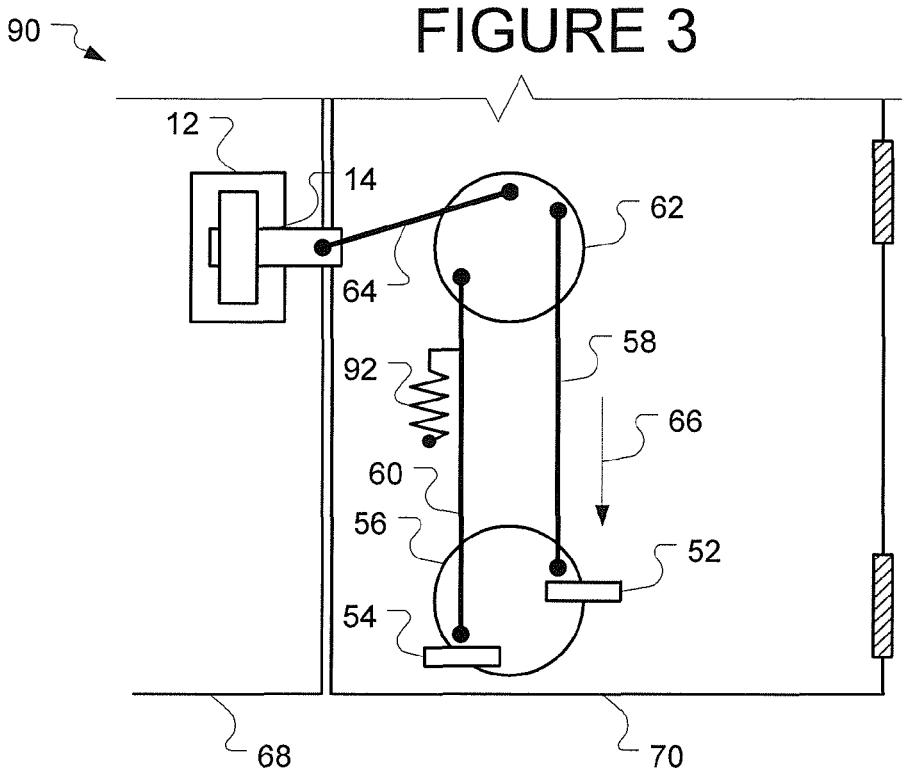
FIG. 3 is a diagram of a door latch system using pedals according to another embodiment.

FIG. 3 is a diagram of a door latch system using pedals according to another embodiment. In this embodiment, the latch system 90 is similar to the latch system 50 of FIG. 2. However, a spring 92 is illustrated as an example of a bias that can be introduced into the mechanical linkages to cause the bolt 14 to remain in the latched position. Accordingly, a user can still press in direction 66 on pedal 52 to actuate the bolt 14.

Figure 4:
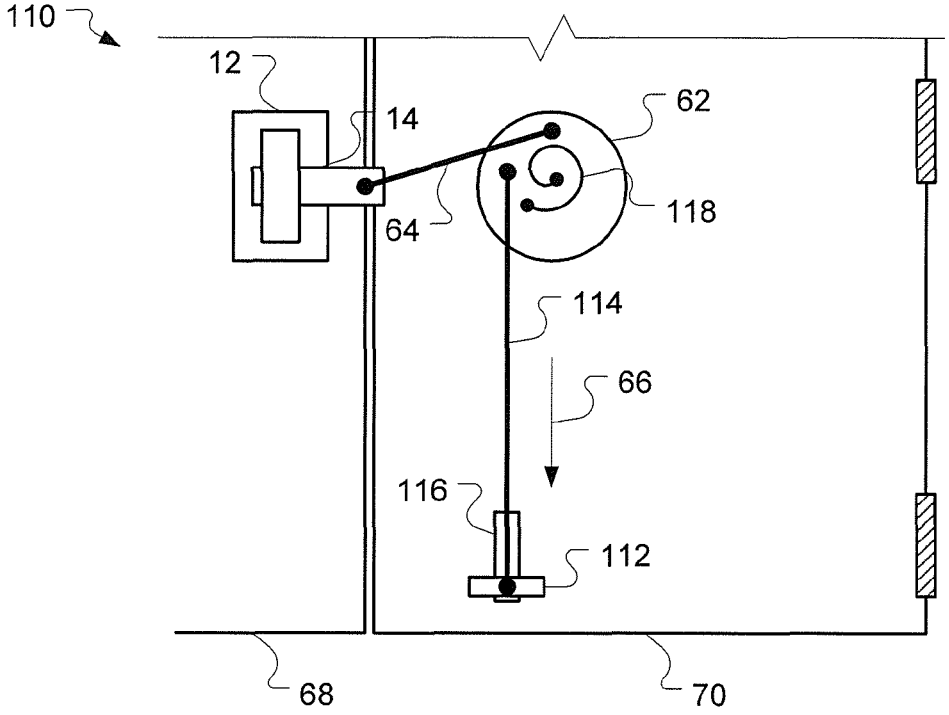
FIG. 4 is a diagram of a door latch system using pedals according to another embodiment.

FIG. 4 is a diagram of a door latch system using pedals according to another embodiment. As described above, linear motion of a user's foot was translated to rotational movement of a first disk, linear movement of a linkage, rotational movement of a second disk, linear movement of another linkage and linear movement of the bolt 14. However, in an embodiment, any form of motion of a user's foot whether linear, rotational, or the like can be used to actuate the bolt 14.

In this embodiment, the door 70 includes a slot 116. Pedal 112 is configured to move linearly within the slot 116. Thus, when a user presses in direction 66 on the pedal 112, the pedal 112 can move down along the slot 116. As a result, linkage 114 can translate the linear motion of the pedal 112 to the disk 62 and eventually to the bolt 14 as described above.

In this embodiment, a torsion spring 118 is illustrated as coupled to the disk 62. The torsion spring can be configured to cause the disk 62 to rotate such that the bolt 14 remains in a particular state, such as the latched position or the unlatched position. Accordingly, the latch system 90 can include one pedal 112 as the locking function can be performed by the spring 118. Furthermore, the torsion spring 118 illustrates that any variety of biasing mechanisms can be used to introduce a force into the various linkages.

Figure 5:
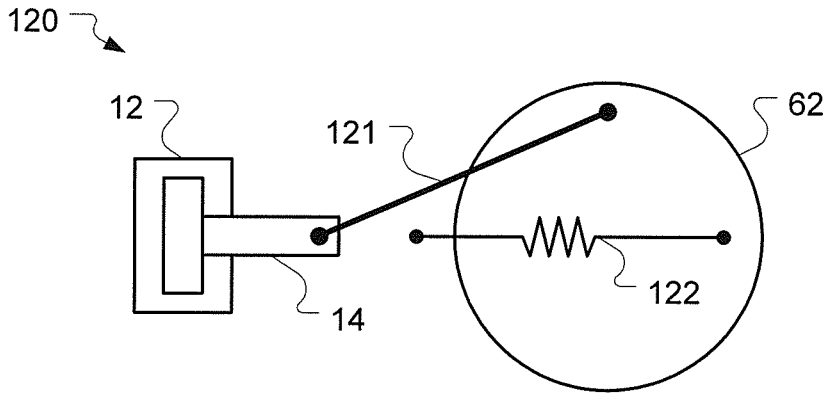
FIGS. 5-7 illustrate an operation of a mechanism of the door latch system of FIG. 4.
Figure 6:
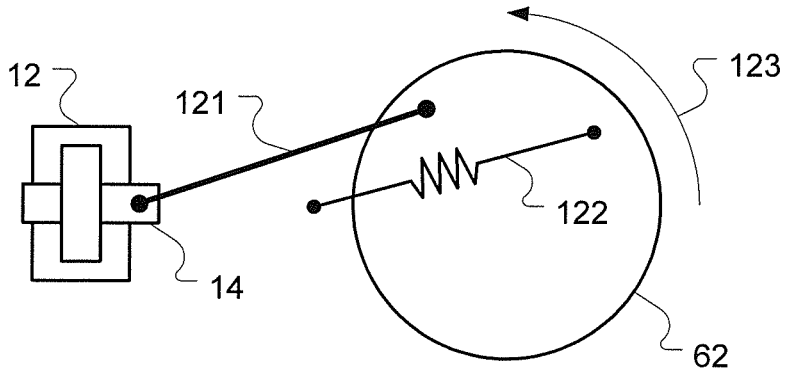
Figure 7:
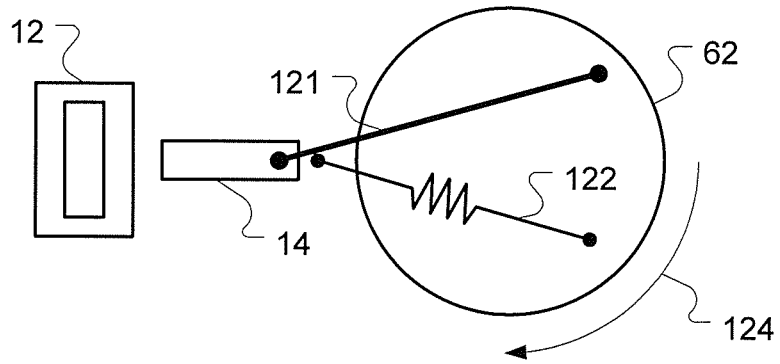

FIGS. 5-7 illustrate an operation of a mechanism of the door latch system of FIG. 4. In this embodiment, the door latch system 120 can be a bi-stable system. That is, the door latch system 120 can maintain two stable states. FIG. 5 illustrates the door latch system 120 in a neutral state. In this state, the spring 122 is extended. Accordingly a force is applied to the disk 62. However, as this force can be in line with an axis of rotation of the disk 62.

Referring to FIG. 6, if a force is applied to the disk 62 to latch the door latch system 120, the spring 122 can aid in rotating the disk in direction 123, engaging the latch through linkage 121. Alternatively, referring to FIG. 7 if a force is applied to the disk 62 in the direction 124, the spring 122 can rotate the disk in direction 124, unlatching the door system 120. Whether in the latched state of FIG. 6 or the unlatched state of FIG. 7, a force can be applied to the disk 62 in a desired direction. Once the disk 62 rotates past the position illustrated by FIG. 5, the door latch system can transition from one stable state to another.

Figure 8:
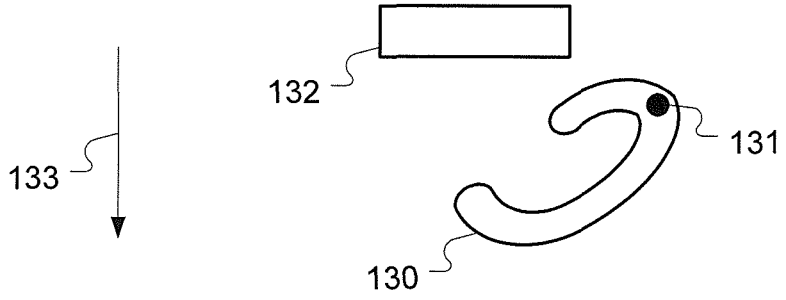
FIGS. 8-12 illustrates an operation of a pedal catch system for a door latch system according to an embodiment.
Figure 9:
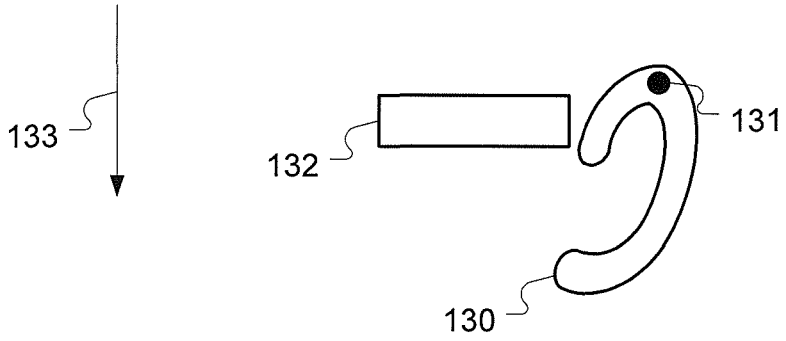
Figure 10:
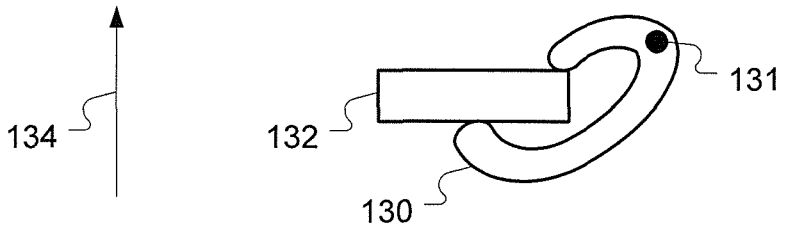

FIGS. 8-12 illustrates an operation of a pedal catch system for a door latch system according to an embodiment. In an embodiment, a spring, weight, or other biasing mechanism may apply a force only in one direction. As illustrated in FIGS. 8 and 9 a pedal 132 can be pressed in direction 133 causing catch 130 to rotate about location 131. When released, the pedal 134 may attempt to return in direction 134 as illustrated in FIG. 10. However, the pedal interlocks with catch 130.

Figure 11:
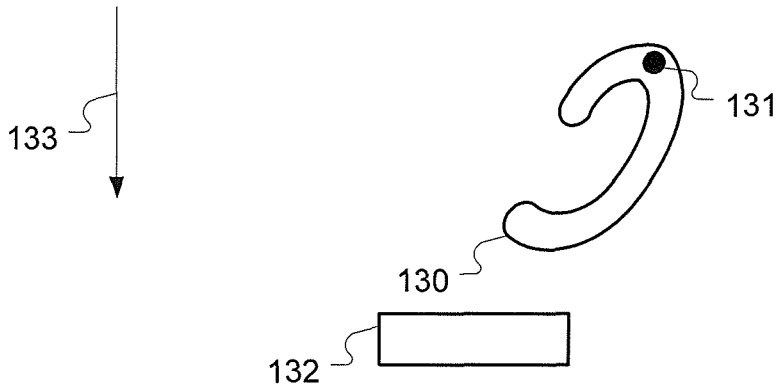
Figure 12:
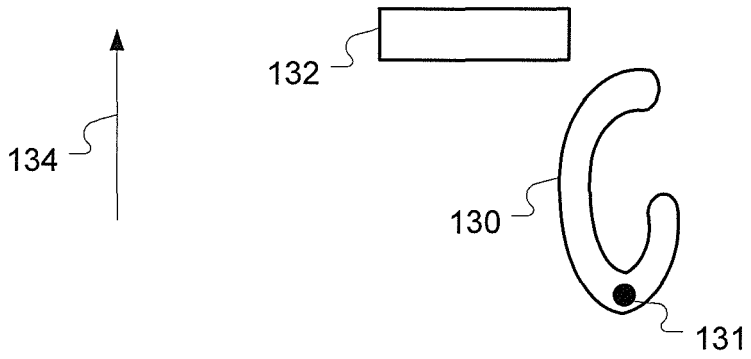
Figure 14:
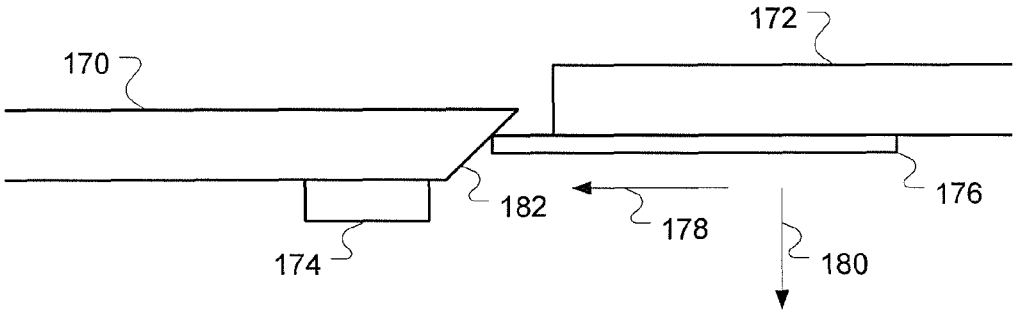
FIGS. 14 and 15 illustrate a closing operation of a door latch system according to an embodiment.

As illustrated in FIG. 11, the pedal 133 can be pressed further in direction 133 such that it passes pedal 130. The catch 130 can include a spring or other biasing mechanism that applies a force to return the catch 130 to a particular state. Once the pedal 132 passes the catch 130, the catch 130 can rotate back to the steady state. The pedal can be release and as illustrated in FIG. 14 travel in direction 134 and rotate the catch 130 out of the way. The catch 130 can then rotate in direction 136 to return to the steady state as illustrated in FIG. 8. Accordingly, a user of a waste facility can use only pressure in a single direction, such as downward, to both latch and unlatch the door. Although the pedal 132 has been illustrated as interacting with the catch 130, any suitably formed structure can interact with the catch.

Figure 13:
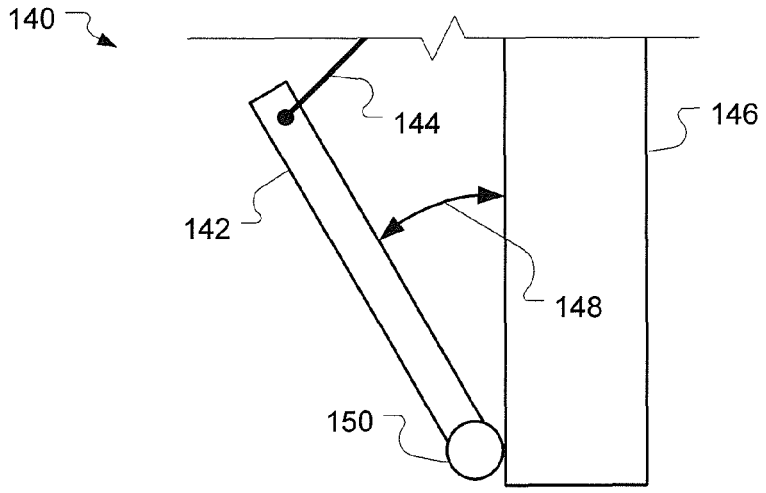
FIG. 13 is a diagram of a foot actuator for a door latch system according to an embodiment.

FIG. 13 is a diagram of a foot actuator for a door latch system according to an embodiment. In this embodiment, the foot actuator 140 includes a pedal 142 rotatably mounted to a door 146. The pedal 142 can be coupled to the door 146 through a hinge 150. Accordingly, the pedal 142 can rotate back and forth along direction 148.

Linkage 144 can couple the pedal 142 such that the rotation of the pedal 142 can actuate the bolt as described above. However, in this embodiment, the direction of the force applied to the pedal can be substantially perpendicular to the plane of the door 146. Thus, with a single motion the user can unlatch the door 146 and continue to push the door open.

Figure 15:
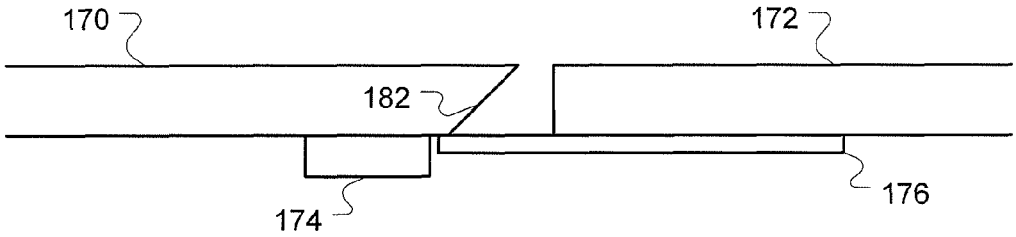

FIGS. 14 and 15 illustrate a closing operation of a door latch system according to an embodiment. In an embodiment, when a user enters a waste facility, the door may close slightly, but may not seal. As illustrated in FIG. 14, the frame 170 can include a surface 182 such as a strike plate, or the like, on which the bolt 176 can impact as a user operates the latch mechanism. As the bolt 176 is moved in direction 178, a slope of the surface 182 can pull the door 172 in direction 180. The surface 182 can be formed such that once the door attains a desired position relative to the frame 170, the bolt 176 can continue towards the latch plate 174.

Figure 16:
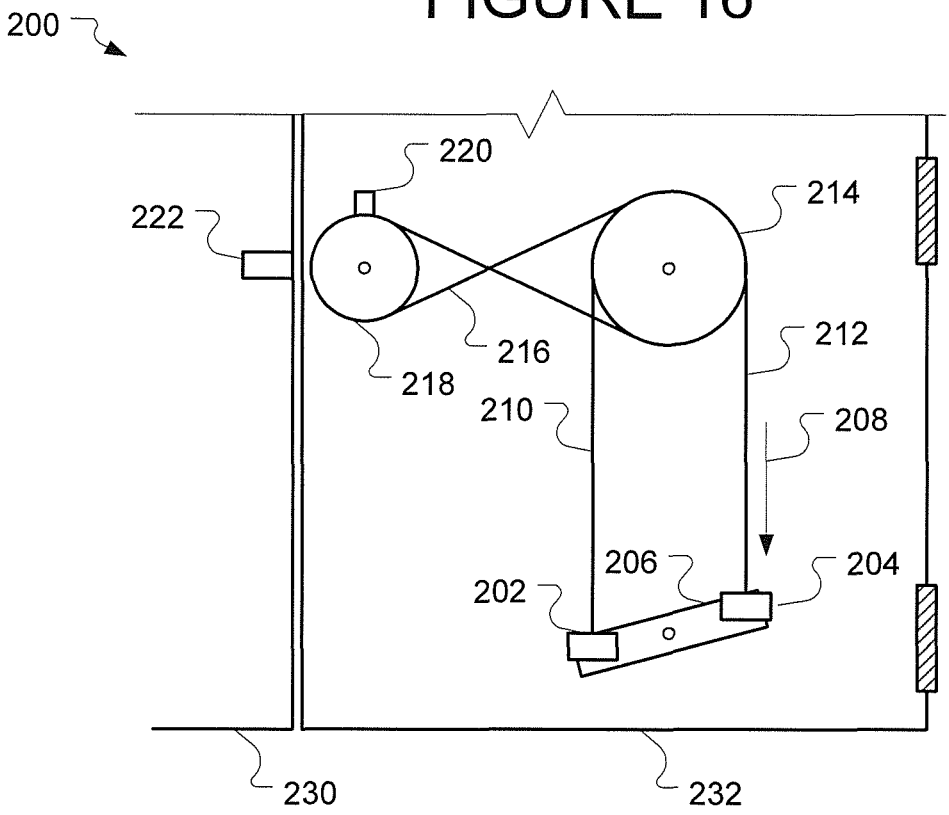
FIG. 16 is a diagram of a door latch system using pedals according to another embodiment.

FIG. 16 is a diagram of a door latch system using pedals according to another embodiment. In this embodiment, the latch system 200 has a foot actuator that includes two pedals 202 and 204 coupled to a panel 206. The panel 206 may have a shape that is substantially rectangular, for example. A user can step on either of the pedals 202 and 204 to cause the panel 206 to rotate in a certain direction. For example, a user may step on pedal 204 in direction 208 to cause the panel 206 to rotate in a clockwise direction.

In the example, two linkages 210 and 212 couple the panel 206 to a first disk 214. In certain embodiments, the linkages 210 and 212 comprise a single component, e.g., a string or rope, that is fixedly coupled to both pedals 202 and 204 but winds or wraps around the top portion of the disk 214 and may or may not be fixedly coupled thereto.

In this embodiment, the linkages 210 and 212 effectively couple the panel 206 and the disk 214 such that the panel 206, when rotating in response to actuation of the pedals 202 or 204, causes the disk 214 to also rotate. For example, the disk 214 would rotate in a clockwise direction, e.g., from a first substantially fixed position to a second substantially fixed position, as a direct result of the panel 206 rotating in a clockwise direction responsive to a user stepping on pedal 204 in direction 208.

In the example, the disk 214 is coupled to another disk 218 by way of a linkage 216. The linkage 216 may comprise a string, rope, or other suitable item that winds or wraps around both disks 214 and 218 such that a rotation of one causes a rotation of the other in an opposite direction. For example, a clockwise rotation of the first disk 214 would cause the second disk 218 to rotate in a counterclockwise direction. This linkage 216 may or may not be fixedly coupled to either of the disks 214 and 218.

A locking mechanism may include a tab 220 and a receiving member 222. In the example, the tab 220 is mounted on a sidewall 230 while the other components 202-220 are effectively or fixedly coupled to a door 232. Alternatively, the tab 200 may be mounted on the door 232 and the other components 202-220 effectively or fixedly coupled to the sidewall 230.

In the example, the tab 220 is coupled to the second disk 218. The tab 220 may be formed as part of the disk 218 or as a separate component that is fixedly coupled to the disk 218. The receiving member 222 may be configured to receive the tab 220 such that locking mechanism is engaged whenever the receiving member 222 receives the tab 220.

The locking mechanism is presently illustrated in an open position, i.e., the receiving member 222 is not presently receiving the tab 220. However, should a user actuate the foot actuator by stepping on pedal 204 in direction 208, the panel 206 would rotate in a clockwise direction and, consequently, the first disk 214 would also rotate in a clockwise manner. This would trigger the second disk 218 to rotate in a counterclockwise manner and, as a result, the locking mechanism would transition from a first, unlocked state to a second, locked state, i.e., the tab 220 would rotate from the illustrated first position to a second position. Assuming the door 232 is at least substantially closed, the receiving member 222 would receive the tab 220, effectively locking the door 232 in the closed position.

In situations where the door 232 is locked in the closed position, a user can press on the other pedal 202 to unlock the door. In this manner, the user need not have skin contact with a surface of a waste facility whether entering or exiting.

Although illustrated as exposed, the various linkages, disks, and the like can be concealed behind panels of the door 232 or sidewall 230. Thus, the various moving parts can be protected, and a user can be protected from the moving parts.

Figure 17:
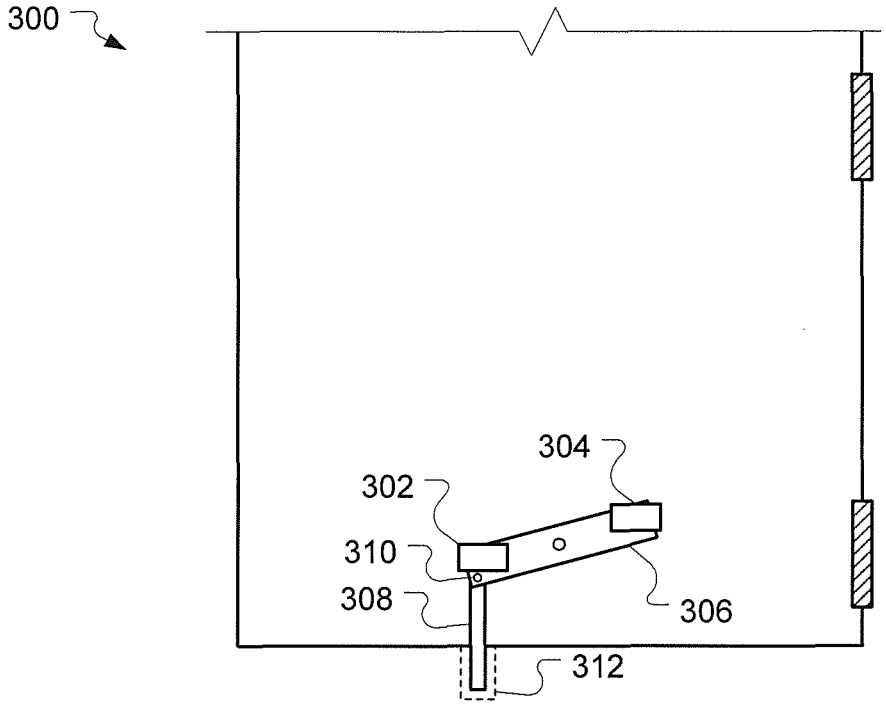
FIG. 17 is a diagram of a door latch system using pedals according to another embodiment.

FIG. 17 is a diagram of a door latch system using pedals according to another embodiment. In this embodiment, the latch system 300 has a foot actuator that includes two pedals 302 and 304 coupled to a panel 306. The panel 306 may have a shape that is substantially rectangular, for example. A user can step on either of the pedals 302 and 304 to cause the panel 306 to rotate in a certain direction. For example, a user may step on pedal 302 to cause the panel 306 to rotate in a counterclockwise direction.

A locking mechanism may include a locking member 308 and a receiving member 312 configured to receive the locking member 308. The locking member 308 may be coupled to the panel 306 by way of a hinge 310 or other suitable connecting device. In the example, the foot actuator and locking member 308 are situated on or integrated within the door and the receiving member 312 is situated on or integrated with another portion such as the frame or a base member, e.g., floor.

In the example, the locking mechanism is presently illustrated in a closed or locked position, i.e., the receiving member 312 is presently receiving the locking member 308. However, should a user actuate the foot actuator by stepping on pedal 304, the panel 306 would rotate in a clockwise direction and, consequently, the locking member 308 would be lifted up and out of the receiving member 312. Thus, the locking mechanism would transition from a first, locked state to a second, unlocked state, i.e., the locking member 308 would move from the illustrated first position to a second position.

Figure 18:
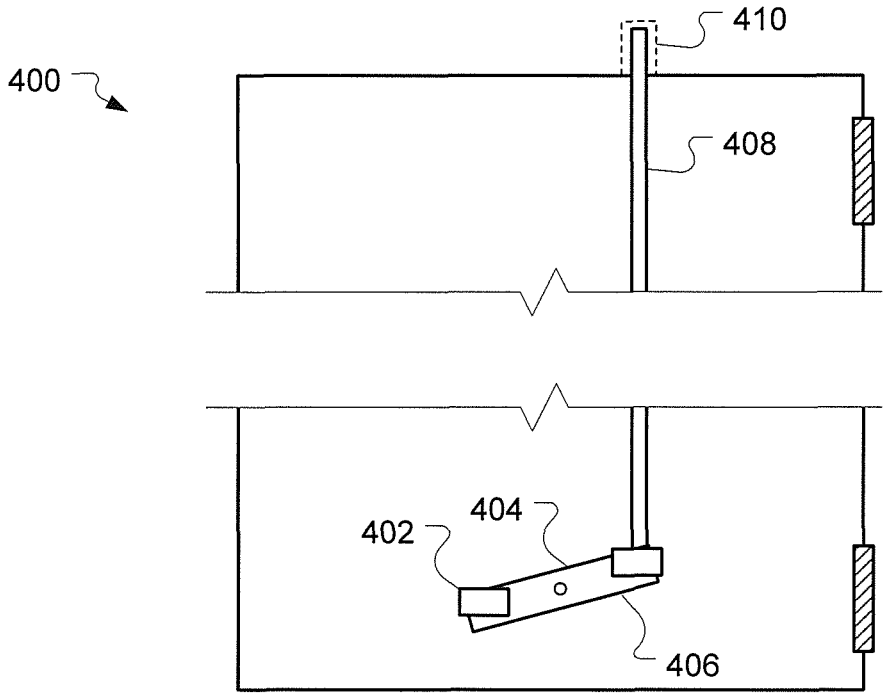
FIG. 18 is a diagram of a door latch system using pedals according to another embodiment.

FIG. 18 is a diagram of a door latch system using pedals according to another embodiment. In this embodiment, the latch system 400 has a foot actuator that includes two pedals 402 and 404 coupled to a panel 406. The panel 406 may have a shape that is substantially rectangular, for example. A user can step on either of the pedals 402 and 404 to cause the panel 406 to rotate in a certain direction. For example, a user may step on pedal 402 to cause the panel 406 to rotate in a counterclockwise direction.

A locking mechanism may include a locking member 408 and a receiving member 410 configured to receive the locking member 408. The locking member 408 may be coupled to the panel 406 by way of a hinge (not shown) or other suitable connecting device. In the example, the foot actuator and locking member 408 are situated on or integrated within the door and the receiving member 410 is situated on or integrated with another portion such as the frame or an upper member, e.g., ceiling.

In the example, the locking mechanism is presently illustrated in a closed or locked position, i.e., the receiving member 410 is presently receiving the locking member 408. However, should a user actuate the foot actuator by stepping on pedal 404, the panel 406 would rotate in a clockwise direction and, consequently, the locking member 408 would be pulled down and out of the receiving member 410. Thus, the locking mechanism would transition from a first, locked state to a second, unlocked state, i.e., the locking member 408 would move from the illustrated first position to a second position.

In alternative embodiments, a door latch system may include a locking mechanism that includes any combination of the locking mechanisms illustrated and described herein. For example, a door latch system may include the locking member 308 and receiving member 312 of FIG. 17 and the locking member 408 and receiving member 410 of FIG. 18.

Although the above door latch systems have been described in the context of a portable waste facility, the door latch system can be used where hand contact is undesired for other reasons. For example, a stall in a fixed waste facility can use such a latch system on a stall door. In another example, a hospital door separating a washing station from an operating room can have such a mechanism. Thus, a surgeon need not touch the door prior to operating. The door latch systems described above can be use in any application where a lack of skin contact is desired.

Although rigid mechanical linkages have been described above, flexible linkages, safety mechanisms, or the like can be incorporated in the linkages. For example, the linkages can include springs, compressible telescoping tubing, or the like, such that if an unexpected obstruction occurs, the actuation of the foot actuator 18 as described above will not result in the full force of a user's body weight being applied to the obstruction.

Although particular embodiments have been described, it will be appreciated that the principles of the invention are not limited to those embodiments. Variations and modifications may be made without departing from the principles of the invention.

In view of the wide variety of permutations to the embodiments described herein, this detailed description and accompanying material is intended to be illustrative only, and should not be taken as limiting the scope of the invention. What is claimed as the invention, therefore, is all such modifications as may come within the scope and spirit of the following claims and equivalents thereto.

The invention claimed is:

1. A door latch system, comprising:

a foot actuator;

a first disk;

a first linkage coupled to the foot actuator and the first disk, wherein the first linkage is configured to rotate the first disk from a first position to a second position responsive to a user actuating the foot actuator;

a locking mechanism;

a second linkage coupled to the first disk and the locking mechanism, wherein the second linkage is configured to cause the locking mechanism to transition from a first state to a second state responsive to the first disk rotating from the first position to the second position; and an occupancy indicator coupled to the foot actuator, wherein the occupancy indicator is configured to transition from a first state to a second state responsive to a user actuating the foot actuator.

2. A door latch system according to claim 1, wherein the foot actuator comprises at least one pedal.

3. A door latch system according to claim 2, wherein the first linkage is configured to rotate the first disk from the first position to the second position responsive to the user stepping on a first pedal, and wherein the first linkage is further configured to rotate the first disk from the second position back to the first position responsive to the user stepping on a second pedal.

4. A door latch system according to claim 2, wherein the foot actuator further comprises a second disk coupled to the at least one pedal, and wherein the second disk is configured to rotate from a first position to a second position responsive to the user stepping on the at least one pedal.

5. A door latch system according to claim 2, wherein the foot actuator further comprises a panel coupled to the at least one pedal, and wherein the panel is configured to rotate from a first position to a second position responsive to the user stepping on the at least one pedal.

6. A door latch system according to claim 1, wherein the locking mechanism comprises a second disk, and wherein the second linkage is configured to cause the locking mechanism to transition from the first state to the second state by rotating the second disk from a first position to a second position.

7. A door latch system according to claim 6, wherein the locking mechanism further comprises a tab coupled to the second disk.

8. A door latch system according to claim 7, wherein the locking mechanism further comprises a receiving member configured to receive the tab.

9. A door latch system according to claim 8, wherein a door is configured to be locked in a closed position responsive to the receiving member receiving the tab.

10. A door latch system according to claim 1, wherein the first linkage comprises a single component.

11. A door latch system, comprising:

a foot actuator;

a first disk;

a first linkage coupled to the foot actuator and the first disk, wherein the first linkage is configured to rotate the first disk from a first position to a second position responsive to a user actuating the foot actuator;

a locking mechanism;

a second linkage coupled to the first disk and the locking mechanism, wherein the second linkage is configured to cause the locking mechanism to transition from a first state to a second state responsive to the first disk rotating from the first position to the second position; and a light switch coupled to the foot actuator, wherein the light switch is configured to transition from a first state to a second state responsive to a user actuating the foot actuator.

12. A door latch system according to claim 11, wherein the foot actuator comprises at least one pedal.

13. A door latch system according to claim 12, wherein the first linkage is configured to rotate the first disk from the first position to the second position responsive to the user stepping on a first pedal, and wherein the first linkage is further configured to rotate the first disk from the second position back to the first position responsive to the user stepping on a second pedal.

14. A door latch system according to claim 12, wherein the foot actuator further comprises a second disk coupled to the at least one pedal, and wherein the second disk is configured to rotate from a first position to a second position responsive to the user stepping on the at least one pedal.

15. A door latch system according to claim 12, wherein the foot actuator further comprises a panel coupled to the at least one pedal, and wherein the panel is configured to rotate from a first position to a second position responsive to the user stepping on the at least one pedal.

16. A door latch system according to claim 11, wherein the locking mechanism comprises a second disk, and wherein the second linkage is configured to cause the locking mechanism to transition from the first state to the second state by rotating the second disk from a first position to a second position.

17. A door latch system according to claim 16, wherein the locking mechanism further comprises a tab coupled to the second disk.

18. A door latch system according to claim 17, wherein the locking mechanism further comprises a receiving member configured to receive the tab.

19. A door latch system according to claim 18, wherein a door is configured to be locked in a closed position responsive to the receiving member receiving the tab.

20. A door latch system, comprising:

a foot actuator;

a first disk;

a first linkage coupled to the foot actuator and the first disk, wherein the first linkage is configured to rotate the first disk from a first position to a second position responsive to a user actuating the foot actuator;

a locking mechanism;

a second linkage coupled to the first disk and the locking mechanism, wherein the second linkage is configured to cause the locking mechanism to transition from a first state to a second state responsive to the first disk rotating from the first position to the second position; and a lid actuator coupled to the foot actuator, wherein the lid actuator is configured to transition a toilet lid from a first position to a second position responsive to a user actuating the foot actuator.

* * * * *